US007987999B2

(12) United States Patent
Weigand et al.

(10) Patent No.: US 7,987,999 B2
(45) Date of Patent: Aug. 2, 2011

(54) PRODUCT DISPLAY HIGHLIGHTER

(75) Inventors: Christopher P. Weigand, Sagamore Hills, OH (US); Gary A. Hodge, Rutherfordton, NC (US)

(73) Assignee: American Greetings Corporation, Cleveland, OH (US)

( * ) Notice: Subject to any disclaimer, the term of this patent is extended or adjusted under 35 U.S.C. 154(b) by 455 days.

(21) Appl. No.: 12/355,119

(22) Filed: Jan. 16, 2009

(65) Prior Publication Data

US 2010/0181449 A1 Jul. 22, 2010

(51) Int. Cl.
*A47F 7/14* (2006.01)

(52) U.S. Cl. ..... 211/55

(58) Field of Classification Search ..... 211/55, 211/184, 43, 50, 51, 78, 85.26, 103, 190, 211/128.1; 108/60, 61; 40/124, 124.05, 40/124.14, 124.16, 124.2, 128.1; 312/50
See application file for complete search history.

(56) References Cited

U.S. PATENT DOCUMENTS 2,333,717 A * 11/1943 Heed et al. ..... 312/50
2,869,732 A * 1/1959 Ganz ..... 211/55
2,938,634 A * 5/1960 Ganz ..... 211/55
3,285,424 A * 11/1966 Emery ..... 211/55
3,298,538 A * 1/1967 Ganz et al. ..... 211/184
3,612,292 A * 10/1971 Nervig ..... 211/184
3,892,450 A * 7/1975 Kolster et al. ..... 312/117
4,613,047 A * 9/1986 Bushyhead et al. ..... 211/55
4,938,365 A 7/1990 Conway et al.
4,949,849 A * 8/1990 Hardy ..... 211/55
5,230,423 A 7/1993 Gellatly
5,289,926 A 3/1994 Lewis et al.
5,513,745 A 5/1996 Zoltan et al.
6,412,648 B1 * 7/2002 Woolnough et al. ..... 211/128.1
6,422,403 B1 * 7/2002 Woolnough et al. ..... 211/55
6,533,118 B1 3/2003 Nelson
6,966,447 B2 11/2005 Hiltke et al.
7,775,379 B2 * 8/2010 Hodge ..... 211/55
2001/0025823 A1 * 10/2001 Brozak ..... 211/55
2005/0139561 A1 * 6/2005 Ohkubo ..... 211/128.1
2005/0269274 A1 12/2005 Costa
2007/0256997 A1 * 11/2007 Collins et al. ..... 211/184
2008/0078728 A1 * 4/2008 Hodge ..... 211/55
2010/0163501 A1 * 7/2010 Berry et al. ..... 211/55

* cited by examiner

*Primary Examiner* — Jennifer E. Novosad
(74) *Attorney, Agent, or Firm* — Roetzel & Andress

(57) ABSTRACT

A product display highlighter has a product carrier body for containing and displaying product, and which is configured to fit with a relatively larger display in a manner in which the product carrier body of the display highlighter and products therein are physically set apart from the products of the larger display. The product display highlighter can be placed at any of multiple locations on a larger display, and multiple product display highlighters can be used in connection with a single larger display.

23 Claims, 6 Drawing Sheets

PRODUCT DISPLAY HIGHLIGHTER

RELATED APPLICATIONS

There are no applications related to this application.

FIELD OF THE INVENTION

The present invention is in the general field of retail display systems and structures, and more particularly to retail store displays for consumer products, including greeting cards and other types of paper and printed products.

BACKGROUND OF THE INVENTION

Greeting card displays in retail stores have taken many forms designed to neatly present a wide variety of cards in a compact arrangement. Common features of such displays are successive rows of card shelves, tiered or vertical, with dividers on each shelf which define card pockets. The shelves are attached to and supported by a back panel which is supported upon a vertically oriented frame, sometimes referred to as a "gondola". The frame may include two spaced-apart upright members with multiple attachment points, and an upright member is attached to span between the upright members. The dividers may be also attached to the back panel, or to the shelves. In some displays, the shelves and dividers are attached to a back panel by fasteners, so that any assembly or adjustment of the display requires removal and re-attachment of such fasteners. Displays are commonly configured with multiple rows wherein the rows are tiered so that the successively lower rows are located farther outboard from the supporting frame of the display, and conversely the successively higher rows are located closer and closer to the frame of the display, and consequently farther or recessed from the front of the display which faces for example an aisle in a store.

Some displays are constructed with a single piece back panel on which the rows are formed. In a tiered display for example, the back panel can be made as a single piece in which multiple tiers are molded to form the card rows. The vertical spacing and tiering of the rows is thus fixed with no provision for adjustment to accommodate cards of different sizes or types. When the back panel is a single homogeneous piece, additional structure must be attached to the panel to form a front to the card pockets. Also, the spacing of the shelves, and the width of the shelves is constant, so that there is little or no flexibility to accommodate cards of different sizes in the same display. In a tiered display for example, the back panel is typically a single piece in which multiple tiers are molded to form the card rows. The vertical spacing of the rows is thus fixed with no provision for adjustment to accommodate cards of different sizes. When the back panel is a single homogeneous piece, additional structure is attached to the panel to form a front to the shelves and form the card pockets, necessitating fasteners along each row to secure the front to the back panel. These types of card displays tend to have a very uniform appearance, with each row having the same width, height and exposed profile to the front of the display. This arrangement makes it difficult to highlight or showcase or distinguish certain products from other products on the display, such as new merchandise which is to be featured or otherwise promoted.

SUMMARY OF THE INVENTION

The present invention provides an improvement to card displays which have multiple rows or tiers of shelves on which pockets are formed for display of cards or other products. By providing an additional product support and display structure which engages with an existing display, product can be displayed in a differentiated or highlighted manner with respect to the remainder of the display, and the total amount of product display capacity is increased.

In accordance with one aspect of the disclosure and related inventions, there is provided a display highlighter for holding and displaying products in combination with and connection to a larger display, the larger display having a plurality of product display shelves, each product display shelf having a shelf bottom, a rear shelf wall which extends from the shelf bottom, and a shelf front which extends from the shelf bottom and which is spaced form the rear shelf wall, the display highlighter and larger display combination including: a product carrier having a front wall, a bottom, and a rear wall; opposing pairs of horizontally disposed brackets on the rear wall, each pair of horizontally disposed brackets forming a channel; a mounting bracket for mounting the display highlighter to the larger display, the mounting bracket having a flange and an arm which extends from the flange, the flange configured to fit in a channel formed by a pair of horizontally disposed brackets on the rear wall of the product carrier of the display highlighter, and the arm of the mounting bracket oriented perpendicular to the flange and configured to fit with a shelf of the larger display and between and perpendicular to the shelf front and the rear shelf wall of the shelf of the larger display, and parallel ribs on each side of the arm; a clip positioned vertically above the shelf, the clip having a planar segment which is generally parallel to the shelf front and to the rear shelf wall of the larger display, and an angled section which is secured to an adjacent shelf of the larger display, the planar segment of the clip bisected by a gap dimensioned to receive the arm of the mounting bracket, the arm of the mounting bracket positioned and engaged with the clip in the gap of the clip with the parallel fibs of the arm overlapping the clip proximate to the gap. Although described in the context of retail display of greeting cards and envelopes, the display can of course be utilized for storage and display of any other products which can be supported by the display.

DETAILED DESCRIPTION OF PREFERRED AND ALTERNATE EMBODIMENTS

Figure 1:
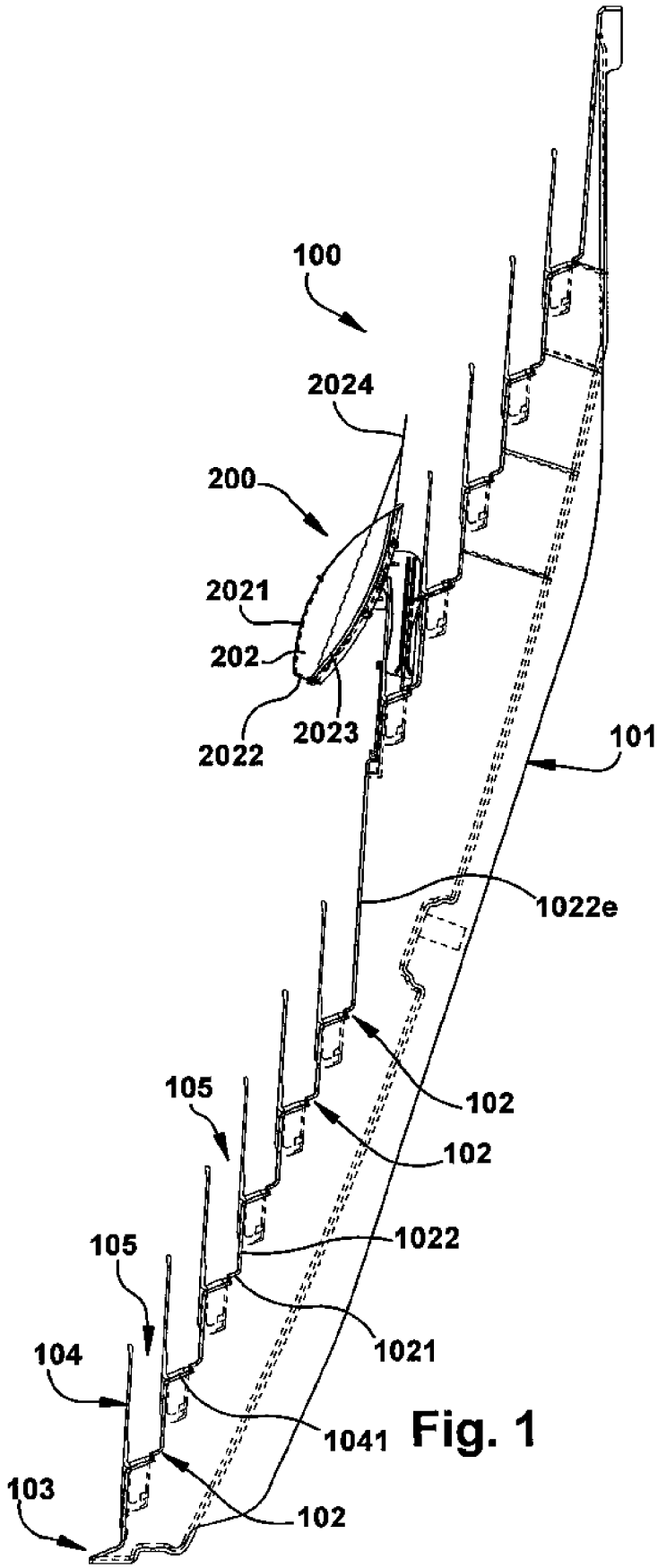
FIG. 1 is a side elevation of a display of the disclosure and related inventions.

With reference to the accompanying drawing figures, there is shown in FIG. 1 a display (also referred to herein as a "larger display"), such as a card display or display for any other type of objects or products, is generally indicated at 100, which in this particular embodiment is in the form of a tiered shelf wall 101 which has multiple shelves or shelf structures 102 which have a shelf bottom 1021 and a rear shelf wall 1022. The shelves 102 are horizontally disposed, parallel, and tiered such that the successively higher shelves 102 are recessed from the adjacent lower shelf relative to a front edge 103 of the display. Each shelf 102 is fitted with a shelf front 104 which has a generally vertically oriented plane which projects from a front edge of the shelf bottom 1021 and extends upward past the next higher shelf to form a pocket 105 between the shelf front 104, the shelf bottom 1021 and the rear shelf wall 1022. The depth of the pocket 105 is generally defined by the vertical extent of the shelf front 104, and the height of the rear shelf wall 1022. The height of any particular rear shelf wall 1022 may be varied with respect to the others, such as the extended rear shelf wall 1022*e* shown in FIG. 1. The width of the pocket 105 is generally defined by the width of the shelf bottom 1021. The vertical plane of the shelf front 104 can be parallel with or non-parallel with the rear shelf wall 1022.

The shelf front 104 can also be attached to or formed integrally with a bottom segment 1041 which fits with the shelf bottom 1021. The bottom segment 1041 has a rear edge 1042 which abuts against the shelf 102 and a front edge 1043 located at the bottom of the shelf front 104. The width of the shelf may vary according to the distance between the front edge 1043 and the rear edge 1042.

A display highlighter, also referred to as a "display sku highlighter", is indicated generally at 200. It is engaged with one of the shelves 102 of the display 100. Although shown engaged with one particular shelf 102, the display highlighter 200 can be engaged with any shelf 102 of the display 100. The display highlighter 200 has a product carrier 202, which in a representative form has a front wall 2021, a bottom 2022 and a rear wall 2023, and in the particular embodiment illustrated the front wall 2021 is generally curvilinear and the rear wall 2023 is generally curvilinear, and the bottom 2022 is generally planar. As further shown in FIG. 2, the front wall 2021 is approximately half the height or vertical extent of the rear wall 2023. An additional product support structure or header 2024 may be inserted into or attached to the product carrier 202 and extend upward from the rear wall 2023. The display highlighter 200 can be configured to hold any type of product by modification of the form and size of the interconnected front wall 2021, bottom 2022 and rear wall 2023.

Figure 2B:
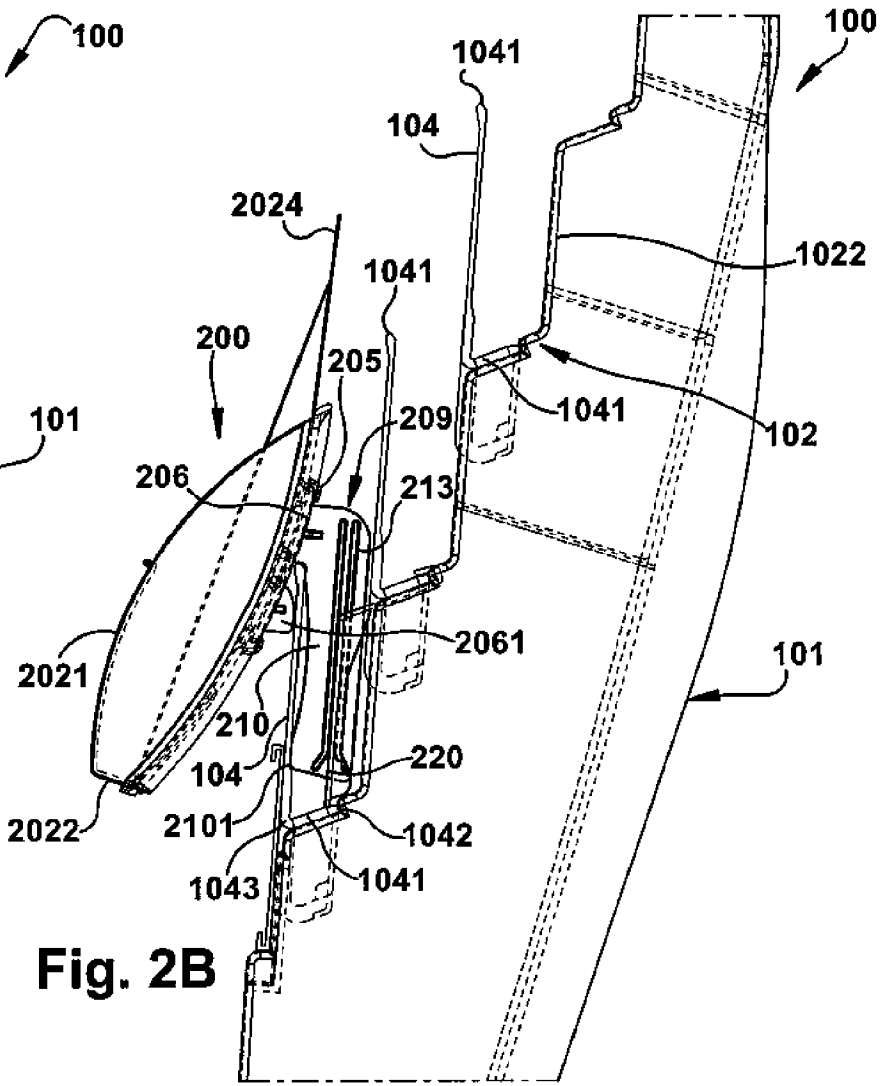
FIGS. 2A and 2B are side elevations of a segment of a display and display highlighter of the disclosure and related inventions.
Figure 2A:
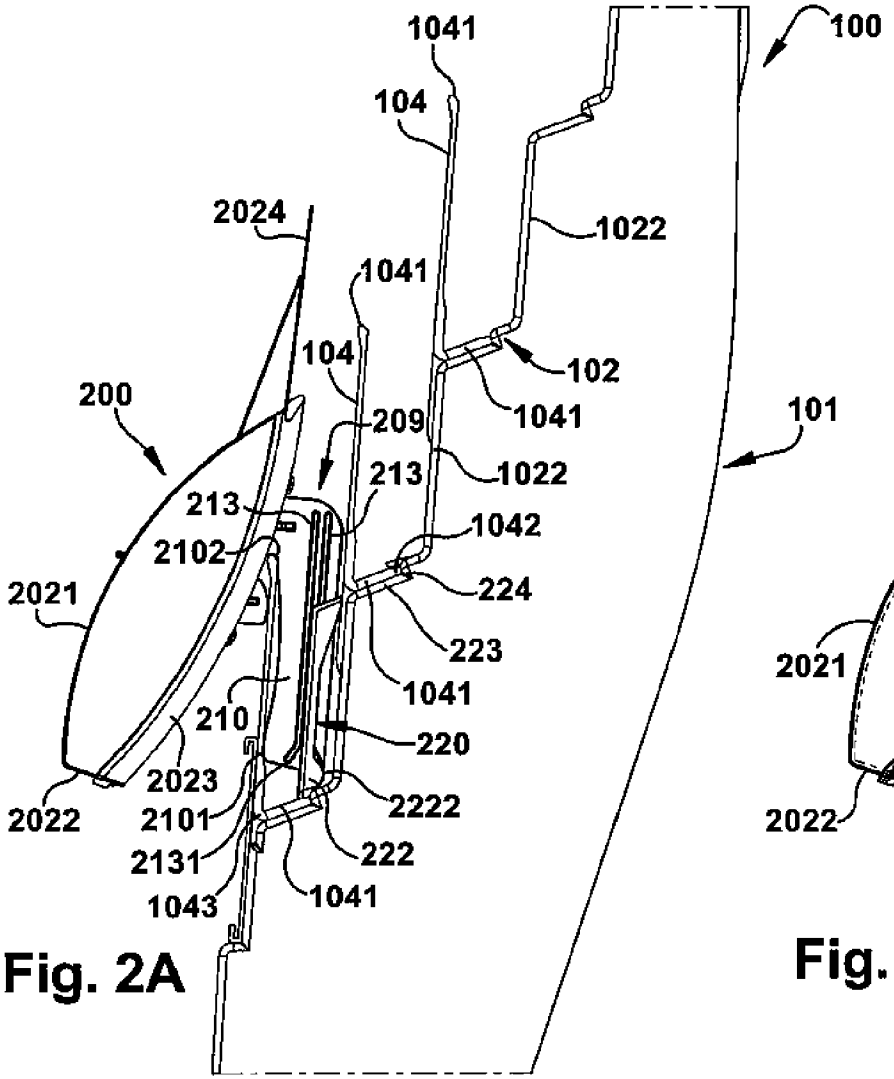
Figure 3:
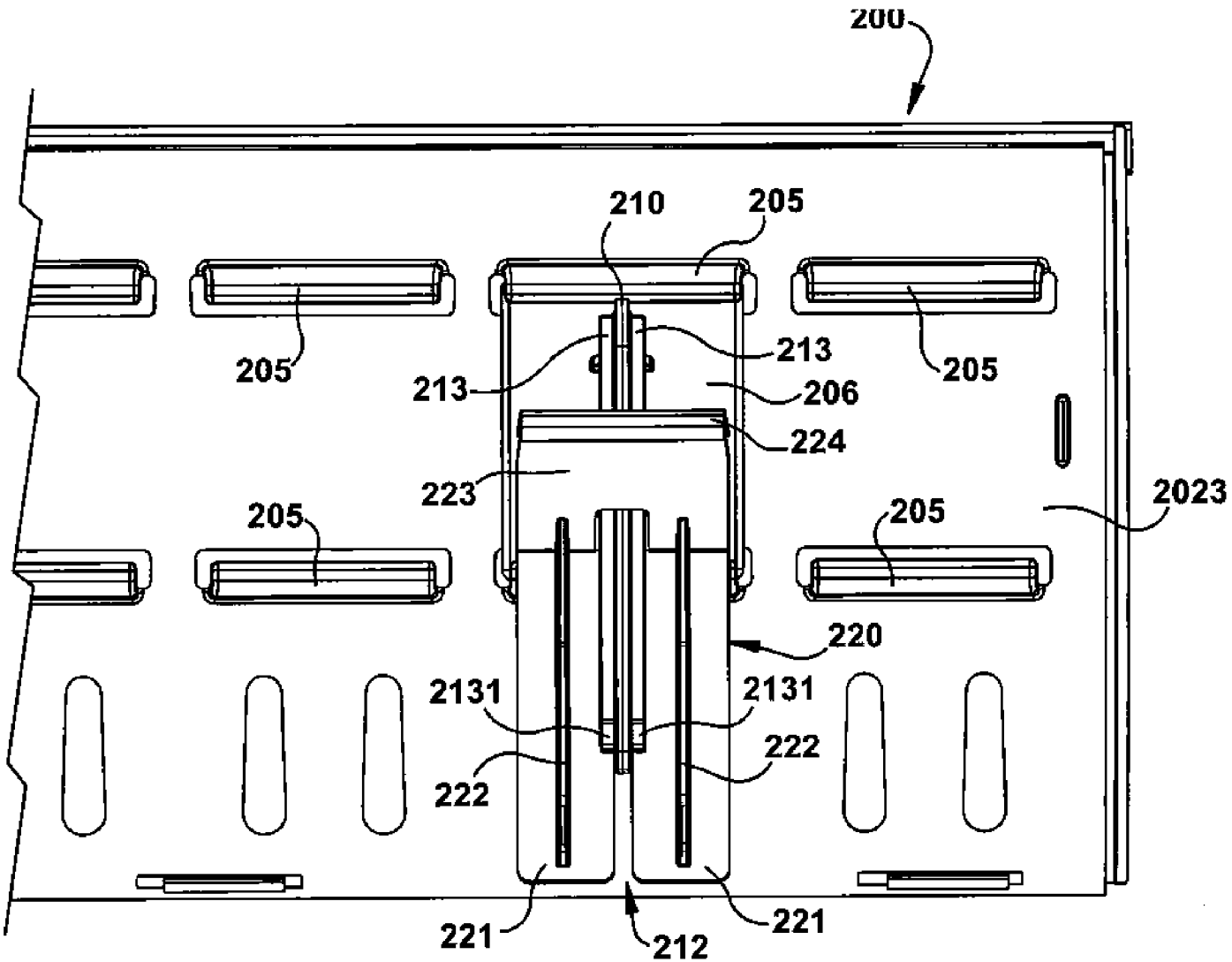
FIG. 3 is a rear elevation of a display highlighter of the disclosure and related inventions.
Figure 4C:
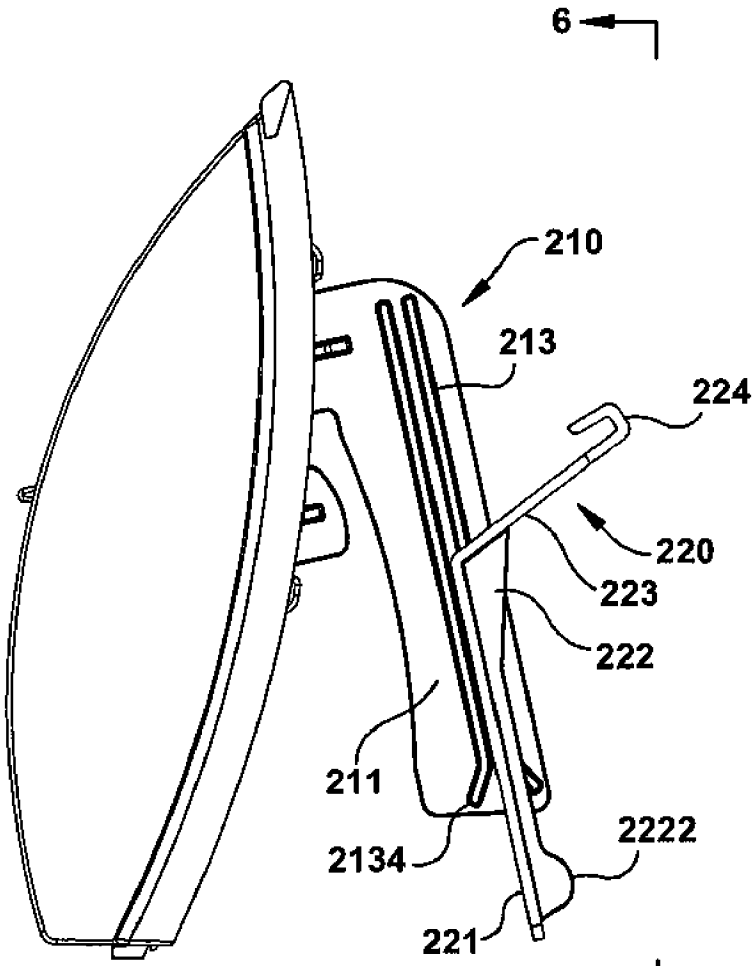
FIG. 4C is a side elevation of the display highlighter of the disclosure and related inventions.
Figure 4A:
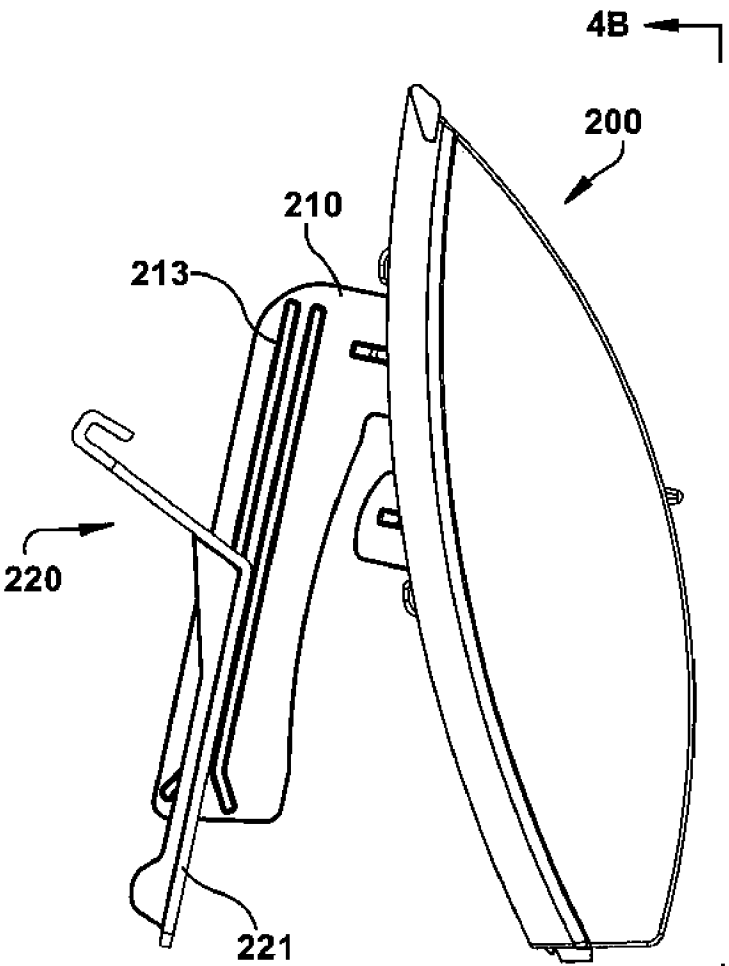
FIG. 4A is a side elevation of a display highlighter of the disclosure and related inventions.
Figure 4B:
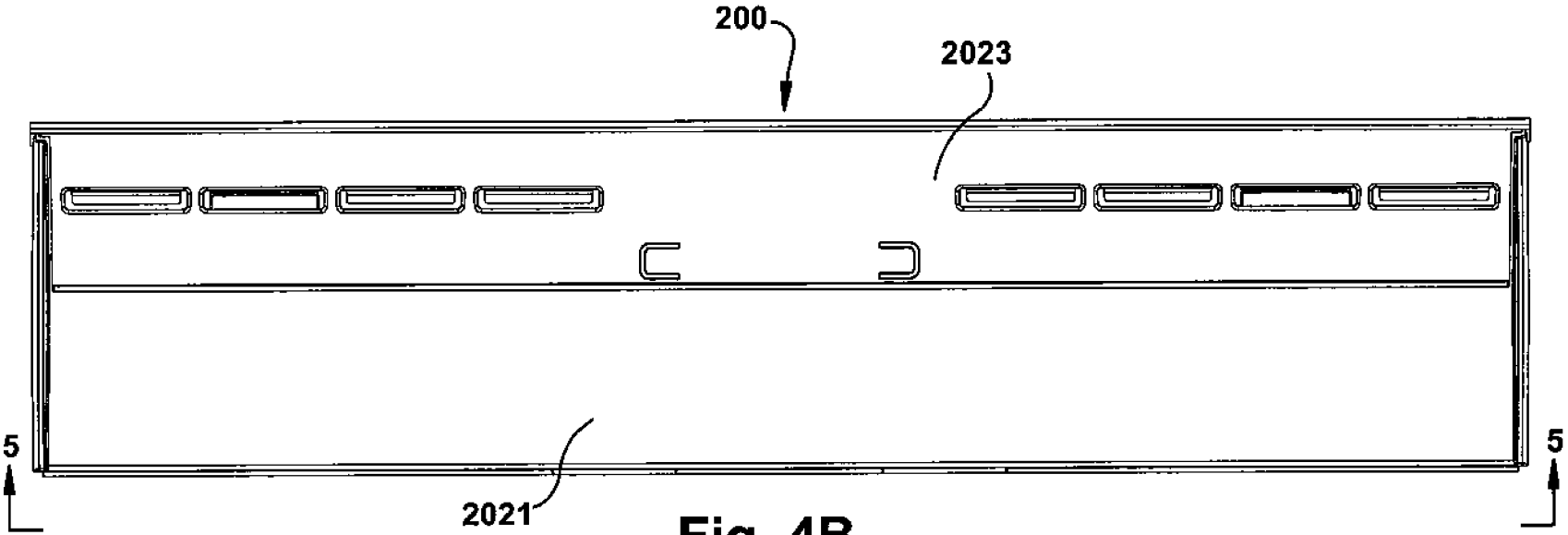
FIG. 4B is a front elevation of the display highlighter of the disclosure and related inventions.
Figure 5:
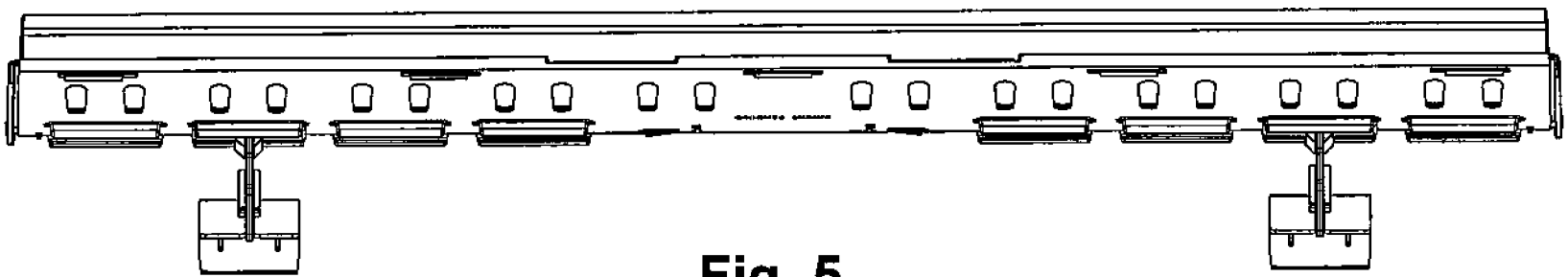
FIG. 5 is a bottom view of the display highlighter of the disclosure and related inventions.
Figure 6:
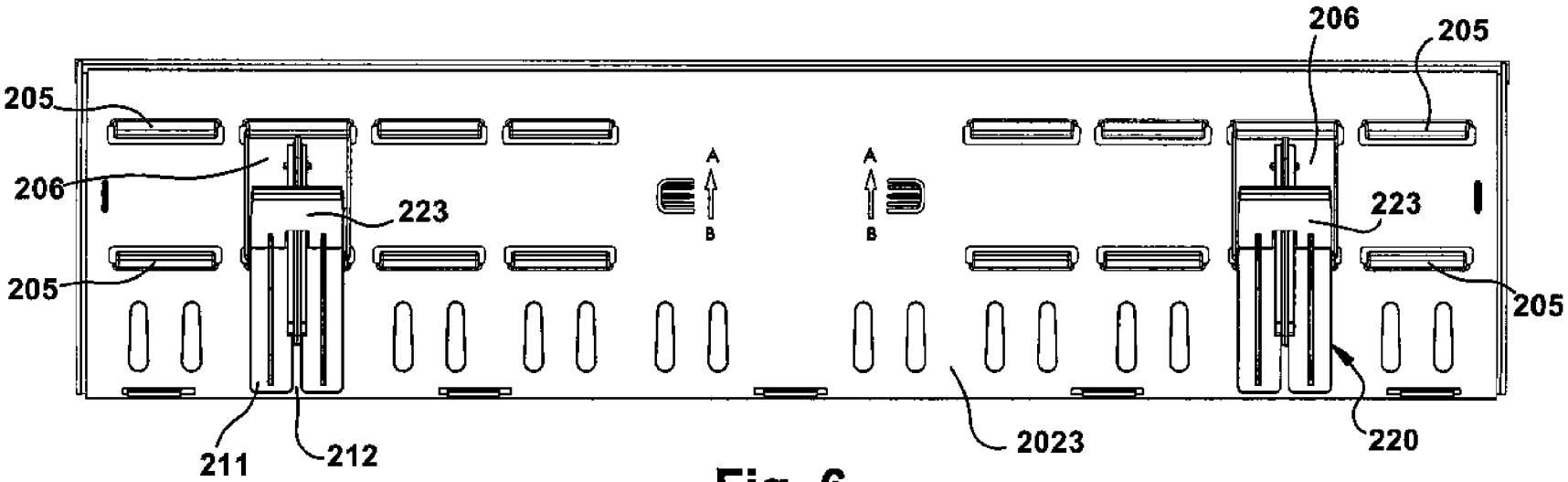
FIG. 6 is a rear elevation of the display highlighter of the disclosure and related inventions.

On the rear wall 2023 of the display highlighter 200 are formed opposing pairs of horizontally disposed brackets 205, each pair of which form a channel for receiving a flange 206 of a mounting bracket 209. An arm or mounting arm 210 of the mounting bracket 209 extends from the flange 206 and downward and is generally configured to fit with a shelf 102 of the display 100, and more particularly between a shelf front 104 and rear shelf wall 1022. The generally planar mounting arm 210 is disposed generally perpendicular to the flange 206, and is generally perpendicular to the shelf front 104 of the shelf 102 with which it is engaged. The flange 206 is oriented at an angle with respect to the arm 209 such that the flange 206 is not parallel with the arm 209. The flange 206 also includes or is formed with a tab 2061 which projects generally perpendicularly from the flange 206 and which is dimensioned to contact and bear against an exterior surface of the shelf front 104, as shown in FIGS. 2A and 2B. With the arm 209 engaged with a shelf 102, and the flange 206 engaged with the brackets 205 of a display highlighter 200, the display highlighter 200 is thus held and oriented at an angle with respect to the shelf 102 and the larger display 100.

As illustrated, multiple arms 210 can be used and engaged with a single display highlighter 200, with the flange 206 of each mounting bracket 209 engaged with a pair of the brackets 205 of the display highlighter 200, and each of the arms 210 engaged with a single display highlighter 200 also engaged with a common shelf 102 of the display 100.

In order to align, stabilize, secure or engage the mounting arms 210 within a shelf 102, a clip 220 is positioned vertically above the shelf 102 and has a vertical planar segment 221 which is generally parallel to with the shelf front 104 and rear shelf wall 1022, and generally closer to the rear shelf wall 1022 than to the shelf front 104. The vertical planar segment 221 of the clip 220 is bisected at gap 212 and through which the mounting arm 210 passes. Parallel ribs 213 on each side of the mounting arm 210 extend over the bisected halves of the planar segment 221 of the clip 220 in order to align, stabilize and/or engage the mounting arm 210 with the clip 220 and with respect to the shelf 102. Flared ends 2131 are formed at the lower ends of the parallel ribs 213 to facilitate engagement of the mounting arm 210 with the clip 220. The clip is also preferably configured with gussets 222 which extend perpendicularly from the planar segment 221, and to an angled section 223. The gussets 222 stiffen the clip 220 and can be configured with one or more projections 2222 which can contact the rear shelf wall 1022 for secure engagement of the clip 220 and the mounting arm 210 with respect to the shelf 102. Similarly, the mounting arm 210 can be configured with one or more projections 2101 at a lower distal end of the mounting arm 210 which can contact an interior surface of the shelf front 104, and an elbow 2102 which contacts a top edge 1041 of the shelf front 104 to provide at least two points of contact of the arm 210 with the shelf front 104 to securely engage the arm 210 with respect to the shelf 102. The angled section 223 of the clip 220 extends at an angle away from the vertical planar segment 221 and away from the mounting arm 210, and terminates with a lip 224. The lip 224 is configured to engage with a rear edge 1042 of the shelf front 104 to secure the clip 220 relative to the shelf 102. The clip 220 can remain installed in this manner with the larger display 100, while the product display highlighter 200 can be removed from the larger display 100 by disengagement of the mounting arms 210 with the clips 220, by sliding movement of the mounting arms 210 relative to the clips 220 and shelf 102. This facilitates restocking and relocation of the product display highlighter 200.

By this construction and configuration and combination of cooperative parts, a product display highlighter is provided which easily fits with a display to provide additional product display capacity and in a highlighted or featured manner, wherein products held by the display highlighter 200 are super-posed over or in front of the display 100, and thereby made more prominent for display and access. The display highlighter 200 can be readily removed and relocated to any shelf 102 of the display 100, and multiple display highlighters 200 can be used in conjunction with a single display 100.

What is claimed as the invention is:

1. A product display highlighter for holding and displaying products in combination with and connection to a larger display, the larger display having a plurality of product display shelves, each product display shelf having a shelf bottom, a rear shelf wall which extends from the shelf bottom, and a shelf front which extends from the shelf bottom and which is spaced form the rear shelf wall, the product display highlighter and larger display combination comprising:

a product carrier having a front wall, a bottom, and a rear wall; opposing pairs of horizontally disposed brackets on the rear wall, each pair of horizontally disposed brackets forming a channel;

a mounting bracket for mounting the display highlighter to the larger display, the mounting bracket having a flange and an arm which extends from the flange, the flange configured to fit in a channel formed by a pair of horizontally disposed brackets on the rear wall of the product carrier of the display highlighter, and the arm of the mounting bracket oriented perpendicular to the flange and configured to fit with a shelf of the larger display and between and perpendicular to the shelf front and the rear shelf wall of the shelf of the larger display, and parallel ribs on each side of the arm;

a clip positioned vertically above the shelf, the clip having a planar segment which is generally parallel to the shelf front and to the rear shelf wall of the larger display, and an angled section which is secured to an adjacent shelf of the larger display, the planar segment of the clip bisected by a gap dimensioned to receive the arm of the mounting bracket, the arm of the mounting bracket positioned and engaged with the clip in the gap of the clip with the parallel ribs of the arm overlapping the clip proximate to the gap.

2. The product display highlighter and larger display combination of claim 1 wherein the flange of the mounting bracket is non-parallel with the arm of the mounting bracket, whereby the product carrier of the display highlighter is held by the mounting bracket at a non-parallel angle relative to the arm of the mounting bracket and at a non-parallel angle relative to the shelf with which the mounting bracket is engaged.

3. The product display highlighter and larger display combination of claim 1 wherein the arm of the mounting bracket has an arcuate profile with a projection which contacts the shelf front, and an elbow which contacts a top edge of the shelf front.

4. The product display highlighter and larger display combination of claim 3 wherein the clip has a projection which contacts the rear shelf wall and which applies pressure to the channels of the arm of the mounting bracket and to the projection of the arm of the mounting bracket for secure engagement of the clip and the arm with the shelf.

5. The product display highlighter and larger display combination of claim 1 wherein the product carrier has eight opposing pairs of horizontally disposed brackets on the rear wall and two mounting brackets each engaged with one of the eight opposing pairs of horizontally disposed brackets.

6. The product display highlighter and larger display combination of claim 1 wherein the product carrier has a generally curvilinear front wall and a generally curvilinear rear wall.

7. The product display highlighter and larger display combination of claim 6 wherein the flange of the mounting bracket is curvilinear and parallel to the rear wall of the product carrier when engaged with the product carrier.

8. The product display highlighter and larger display combination of claim 1 further comprising flared ends of the parallel fibs of the mounting arm.

9. The product display highlighter and larger display combination of claim 1 wherein the front wall of the product carrier is approximately one half in height dimension of a height dimension of the rear wall.

10. The product display highlighter and larger display combination of claim 1 wherein the flange of the mounting bracket further comprises a tab which projects from the flange and which contacts a front surface of the shelf front.

11. The product display highlighter and larger display combination of claim 1 wherein the mounting bracket has only three points of contact with the shelf front, including the tab of the flange on the front surface of the shelf front, an elbow which contacts a point on the top edge of the shelf front, and a projection at a lower distal end of the mounting arm which contacts an interior surface of the shelf front.

12. A product display highlighter for holding and displaying products by connection to a larger display, the larger display having a plurality of product display shelves, each product display shelf having a shelf bottom, a rear shelf wall which extends from the shelf bottom, and a shelf front which extends from the shelf bottom and which is spaced form the rear shelf wall, the product display highlighter comprising:

a product carrier having a front wall, a bottom, and a rear wall; opposing pairs of horizontally disposed brackets on the rear wall, each pair of horizontally disposed brackets forming a channel;

a mounting bracket for mounting the display highlighter to the larger display, the mounting bracket having a flange and an arm which extends from the flange, the flange configured to fit in a channel formed by a pair of horizontally disposed brackets on the rear wall of the product carrier of the display highlighter, and the arm of the mounting bracket oriented perpendicular to the flange and configured to fit with a shelf of the larger display and between and perpendicular to the shelf front and the rear shelf wall of the shelf of the larger display, and parallel ribs on each side of the arm;

a clip positioned vertically above the shelf, the clip having a planar segment which is generally parallel to the shelf front and to the rear shelf wall, and an angled section which is secured to an adjacent shelf of the larger display, the planar segment of the clip bisected by a gap dimensioned to receive the arm of the mounting bracket, the arm of the mounting bracket positioned and engaged with the clip in the gap of the clip with the parallel ribs of the arm overlapping the clip proximate to the gap.

13. The display highlighter of claim 12 wherein the flange of the mounting bracket is non-parallel with the arm of the mounting bracket, whereby the product carrier of the display highlighter is held by the mounting bracket at a non-parallel angle relative to the arm of the mounting bracket.

14. The display highlighter of claim 12 wherein the arm of the mounting bracket has an arcuate profile with a projection which contacts the shelf front and an elbow which contacts a top edge of the shelf front.

15. The display highlighter of claim 14 wherein the clip has a projection which contacts the rear shelf wall and which applies pressure to the channels of the arm of the mounting bracket and to the projection of the arm of the mounting bracket for secure engagement of the clip and the arm with the shelf.

16. The display highlighter of claim 15 wherein the mounting bracket has only three points of contact with the shelf front, including the tab of the flange on the front surface of the shelf front, an elbow which contacts a point on the top edge of the shelf front, and a projection at a lower distal end of the mounting arm which contacts an interior surface of the shelf front.

17. The display highlighter of claim 12 wherein the product carrier has eight opposing pairs of horizontally disposed brackets on the rear wall and two mounting brackets each engaged with one of the eight opposing pairs of horizontally disposed brackets.

18. The display highlighter of claim 12 wherein the product carrier has a generally curvilinear front wall and a generally curvilinear rear wall.

19. The display highlighter of claim 18 wherein the flange of the mounting bracket is curvilinear and parallel to the rear wall of the product carrier when engaged with the product carrier.

20. The display highlighter of claim 12 further comprising flared ends of the parallel ribs of the mounting arm.

21. The display highlighter of claim 12 wherein the front wall of the product carrier is approximately one half in height dimension of a height dimension of the rear wall.

22. The display highlighter of claim 12 wherein the flange of the mounting bracket further comprises a tab which projects from the flange and which contacts a front surface of the shelf front.

23. A display highlighter for holding and displaying products in combination with and connection to a larger display having a plurality of product display shelves with each product display shelf having a shelf bottom, a rear shelf wall which extends from the shelf bottom, and a shelf front which extends from the shelf bottom and which is spaced form the rear shelf wall, and wherein the front wall of the product carrier is approximately one half in height dimension of a height dimension of the rear wall;

the display highlighter comprising:

a product carrier having a curvilinear front wall, a bottom, and a curvilinear rear wall; opposing pairs of horizontally disposed brackets on the rear wall, each pair of horizontally disposed brackets forming a channel;

a mounting bracket for mounting the display highlighter to the larger display, the mounting bracket having a flange and an arm which extends from the flange, the flange configured to fit in a channel formed by a pair of horizontally disposed brackets on the rear wall of the product carrier of the display highlighter, wherein the flange of the mounting bracket is curvilinear and parallel to the rear wall of the product carrier when engaged with the product carrier, and the flange of the mounting bracket further comprises a tab which projects from the flange and which contacts a front surface of the shelf front, and the arm of the mounting bracket oriented perpendicular to the flange and configured to fit with a shelf of the larger display and between and perpendicular to the shelf front and the rear shelf wall of the shelf of the larger display, and parallel ribs on each side of the arm; wherein the arm of the mounting bracket has an arcuate profile with a projection which contacts the shelf front, and an elbow which contacts a top edge of the shelf front, and wherein the flange of the mounting bracket is non-parallel with the arm of the mounting bracket, whereby the product carrier of the display highlighter is held by the mounting bracket at a non-parallel angle relative to the arm of the mounting bracket and at a non-parallel angle relative to the shelf with which the mounting bracket is engaged;

a clip positioned vertically above the shelf, the clip having a planar segment which is generally parallel to the shelf front and to the rear shelf wall of the larger display, and an angled section which is secured to an adjacent shelf of the larger display, the planar segment of the clip bisected by a gap dimensioned to receive the arm of the mounting bracket, the arm of the mounting bracket positioned and engaged with the clip in the gap of the clip with the parallel ribs of the arm overlapping the clip proximate to the gap, and wherein the clip has a projection which contacts the rear shelf wall and which applies pressure to the channels of the arm of the mounting bracket and to the projection of the arm of the mounting bracket for secure engagement of the clip and the arm with the shelf; and whereby the mounting bracket has only three points of contact with the shelf front, including the tab of the flange on the front surface of the shelf front, an elbow which contacts a point on the top edge of the shelf front, and a projection at a lower distal end of the mounting arm which contacts an interior surface of the shelf front.

* * * * *